United States Patent [19]

Feldmann et al.

[11] Patent Number: 4,554,813

[45] Date of Patent: Nov. 26, 1985

[54] LIVE-ROLLER FEED BED FOR CONVEYING INDIVIDUAL LENGTHS OF ROLLED STOCK IN CLOSE SUCCESSION TO COOLING BEDS

[75] Inventors: Hugo Feldmann, Alsdorf; Theodor Gipperich, Dusseldorf; Hans Kirchhoff, Krefeld; Rolf Stodt, Kaarst, all of Fed. Rep. of Germany

[73] Assignee: SMS Schloemann-Siemag Aktiengesellschaft, Dusseldorf, Fed. Rep. of Germany

[21] Appl. No.: 557,838

[22] Filed: Dec. 5, 1983

[30] Foreign Application Priority Data

Dec. 3, 1982 [DE] Fed. Rep. of Germany ..... 3244766

[51] Int. Cl.[4] ..... B21B 43/00

[52] U.S. Cl. ..... 72/251; 72/201; 72/203; 72/252; 83/106; 198/442; 198/447

[58] Field of Search ..... 72/251, 250, 252, 201, 72/203, 14; 83/105, 106; 198/447, 436, 442

[56] References Cited

U.S. PATENT DOCUMENTS

| | | | |
|---|---|---|---|
| 3,602,028 | 8/1971 | Klusmier et al. | 72/252 X |
| 3,951,021 | 4/1976 | Easter | 83/106 X |
| 3,968,671 | 7/1976 | Turner | 72/201 |
| 3,972,410 | 8/1976 | Shaffer et al. | 198/442 |
| 4,250,729 | 2/1981 | Berz | 72/251 |

*Primary Examiner*—Francis S. Husar
*Assistant Examiner*—Steven B. Katz
*Attorney, Agent, or Firm*—Holman & Stern

[57] ABSTRACT

Device to separate without gaps the trailing end of a leading individual length of rolled stock and the leading end of a following length, which are parted from a rolled billet by cross-cutting shears, in the live-roller feed bed upstream of cooling beds, comprises a separate trough section disposed downstream of a switch in the form of a separating diverter subdivided into two parallel longitudinal sections, one with a fixed trough section and one vertically displaceable trough section which forms a depressed portion at a lower level. The switch and the trough section are jointly displaceable in the same direction transversely to the conveying direction in a horizontal plane by a displacement device in such a way that the leading end passes over the trough section in a curved path directed in an inclined manner towards the outer lateral wall of the fixed trough section and after the switch has been shifted the trailing end of the length is drawn in through the trough section disposed at a lower level and forming a depressed portion avoiding lashing of the trailing end of the length discharged from the switch and resultant surface damage even at high run-up speeds.

11 Claims, 12 Drawing Figures

R
2
a
b
c
d
5
5a
5b
5b(5a)
6
6a
6b
6d
6e
7a
7b
8
8a
8b
9
9a
9b
9c
10
10a
19
20
21
F
F1
T
V
VI
VII
VIII

LIVE-ROLLER FEED BED FOR CONVEYING INDIVIDUAL LENGTHS OF ROLLED STOCK IN CLOSE SUCCESSION TO COOLING BEDS

BACKGROUND OF THE INVENTION

1. Field of the Invention

The invention relates to a live-roller feed bed for conveying individual lengths of rolled stock in close succession to cooling beds of a rolling plant.

2. Description of the Prior Art

It is already known to provide live-roller feed beds upstream of cooling beds, for conveying individual lengths of rolled stock in close succession, with a switch or diverter which can be pivoted in a horizontal plane. By means of the switch the individual lengths running in succession in the live-roller feed bed and cut off from a rolled stock billet are each conveyed by their leading end into the fixed longitudinal trough section of a conveying roller table following the discharge end of the switch and comprising two parallel longitudinal troughs, one of which, at the side towards the cooling bed, is in the form of a vertically displaceable braking slide section, and the other of which is in the form of a fixed trough. The two longitudinal sections are separated from one another by a longitudinal section with vertically displaceable separating strips.

When the leading end of an individual length of rolled stock enters the pivotably movable switch section the separating strip is raised in the following trough section, so that the fixed longitudinal trough is separated from the vertically displaceable braking slide section and only after the individual length of rolled stock has run far enough in the fixed trough can it slide over into the longitudinal braking slide section on the conveying plane inclined towards the cooling bed transversely to the conveying direction, after the separating strips have been lowered. Since the separating strips must be raised again before the trailing end leaves the switch, so as to be able to guide the leading end of the following individual length into the fixed trough again, the trailing end of the preceding individual length is withdrawn into the longitudinal braking slide section over the raised separating strip, it being impossible to avoid damage to the surface of the trailing end on account of the upper edge of the separating strip. In addition, at high running speeds of the individual lengths of rolled stock there is a risk of lashing of the trailing end when running over the raised separating strip or entangling the trailing end on the front separating strip.

There is normally no problem in separating the leading trailing end from the following leading end of a rolled stock billet with a round cross-section cut by cross-cutting shears during motion, as long as these lengths of rolled stock with a round cross-section are guided for example in closed tubular guides and are wound up on winders to form rings. Before the leading end of the following individual length of rolled stock is discharged, the switch can be shifted to the new rolled stock guide, so that the trailing end of the leading individual length of rolled stock is withdrawn into the tubular guide in an S-shaped manner and there is no lashing or springing out.

It becomes more difficult if the rolled stock billet must be subdivided into individual lengths upstream of cooling beds of small-section rolling trains. In this connection the rolled stock guides are open towards the top in a U-shaped manner and laterally inclined towards the cooling bed side. In addition, depending on the rolling program, round, flat, angled and U-shaped profiled rods of varying cross-sectional dimensions are conveyed, so that the rolled stock guides must be made relatively wide. Up to approach speeds of approximately 14 m/sec it is possible to separate the successive rolled stock ends from the following leading rod ends by diverting the leading ends without gaps, by tongues raised shortly before the arriving rod ends or wedge-shaped, vertically displaceable plates disposed upstream of the braking slides. In this way the end of the leading length of rolled stock is positively raised, which leads to failure in the case of higher speeds.

Horizontal diversion of the leading end improves the conditions during separation to a certain extent and is possible up to about 16 m/sec. At higher speeds a gap is formed between the end of the separated individual length of rolled stock and the leading end of the following individual length by increasing the conveying speed of the live-roller feed bed with respect to the discharge speed of the rolled stock billet from the rolling train, behind the cross-cutting shears, so that it is possible to change the switch during the gap between the rods without the rod being touched. This can be carried out reliably in operation provided a gap of from 3 to 4 m at a travel velocity of 20 m/sec can be formed. However there are disadvantages. Thus, for example, in the case of an acceleration of the live-roller feed bed of 10% with respect to the rolling speed a distance of 40 m is needed, in order to obtain a gap of 4 m. This necessitates a greater length of the manufacturing shop and additional investment costs. Since braking must be carried out from the increased velocity, there is also an extended braking path. A further disadvantage in the case of roller table rollers driven at increased velocity is that as long as the length of rolled stock is in the rolling train the rollers driven at increased velocity revolve continuously under the length of rolled stock, thus resulting in a high degree of roller wear and in damage to the surface of the material. In the case of relatively small shorts a gap cannot be formed at all, since they follow the leading individual lengths much earlier. Accordingly separation is no longer possible where shorts are very small.

BRIEF SUMMARY OF THE INVENTION

The object of the invention is to develop further the part of the live-roller feed bed following the switch in such a way as to ensure, in a close succession of rods practically without gaps and at high velocities of the individual lengths of rolled stock, that in particular the trailing ends of the individual lengths of rolled stock are separated and conveyed from the switch into the longitudinal braking slide section in an operationally reliable manner in a smooth motion which protects the surface and, in addition, to permit shorter live-roller feed beds at higher circulating speeds.

In order to attain this object it is proposed to interpose between the discharge end of the switch and the leading end of the conveying roller table, which is subdivided into three longitudinal sections, a shorter separate trough section which is movable in a horizontal plane transversely to the conveying line about a vertical pivot axis at the discharge end, is inclined in cross-section towards the cooling bed side and is subdivided into a longitudinal section with fixed base plates and a longitudinal section with base plates which are vertically displaceable independently, it being possible to divert jointly the discharge end of the switch and the inlet end of the trough section laterally in the same direction, the guide walls of the switch being individually displaceably movable at the discharge end in a horizontal plane independently of one another about vertical pivot axes at the entry end, and the stroke of the vertically displaceable base plates of the longitudinal section of the shorter trough section extending from the bottom position below the conveying plane to above the conveying plane of the laterally adjacent longitudinal section.

The advantage of such an apparatus is that in this way an operationally reliable separation is possible even in the case of individual lengths of rolled stock running in succession practically without gaps. This is achieved essentially by the fact that on account of the cooperation of the switch and the shorter trough section disposed downstream thereof the leading end of an individual length of rolled stock leaving the switch first crosses a gap towards the vertically displaceable slide of the shorter trough section in a curved path directed towards the lateral external guide wall on the fixed longitudinal trough section. The individual length of rolled stock then continues with the vertically displaceable slide raised and after the vertically displaceable slide and the longitudinal section with vertically displaceable separating means have been lowered passes, transversely to the conveying direction, into the live-roller feed bed following the shorter trough section, into the longitudinal section with vertically displaceable braking slides and into the slide section. The lowered slide forms a U-shaped depressed portion at a lower level, into which the trailing end of the individual length of rolled stock can withdraw in an operationally reliable manner while protecting the surface and without lashing, even if the switch is shifted before the leading end of the following individual length is discharged into the fixed longitudinal trough section.

Apart from the saving of capital costs with respect to the structural length of the plant and the length of manufacturing shops, the surface quality of the finished products and the operational reliability of the plant can be considerably improved at higher rolling speeds.

Preferably the switch is disposed on a slide table which can be moved about a vertical pivot axis transversely to the conveying direction. In addition, the shorter trough section behind the switch is disposed on a slide table which can be moved about a vertical pivot axis transversely to the conveying direction. The slide tables of the switch and the shorter trough portion are jointly articulated on an adjustment means at their ends facing one another.

At the lateral vertical longitudinal walls of the fixed longitudinal trough section are disposed compressed air nozzles directed towards the fixed trough base and/or towards the trough base of the vertically displaceable slide of the longitudinal trough section in order to accelerate the sliding-over movement of the individual length or for positively influencing the smooth running of the trailing end of the individual length in the depressed portion. The longitudinal section with fixed base plates of the conveying roller table is enlarged in the manner of a funnel on the inlet side for better guidance of the leading end which is entering.

The entry end of the braking section of the live-roller feed bed preferably slopes upwards to form a smooth conveying transition from the lower bottom position of the vertically movable longitudinal section of the short trough section to the conveying plane of the braking section.

The displacement means of the slide tables of the switch and of the short trough section and of the guide walls of the switch can be actuated for example in dependence on the cutting command of the cross-cutting shears by way of a signal transmitter controlled by a computer or controlled as a function of time.

BRIEF DESCRIPTION OF THE DRAWINGS

Exemplary embodiments of the invention will now be described in detail with reference to accompanying the drawings, wherein.

DETAILED DESCRIPTION

FIGS. 1, 2, 3 and 4 show the live-roller feed bed between a final roll stand G of a small-section or medium-section steel rolling train and cooling bed K disposed downstream, in plan view and in cross-section.

A rolled stock billet W discharged from the final roll stand G of a rolling train runs towards the cooling bed K in the conveying direction R on a live-roller feed bed 2 with a fixed run-up trough 2*a* and conveying rollers 2*b* disposed in the conveying plane F with their longitudinal axes at right angles to the conveying direction R in a horizontal plane. In cross-cutting shears S the rolled stock billet W is cut into individual lengths T of rolled stock suitable for the cooling bed. The individual lengths T, which arrive at the cooling bed K in rapid succession, i.e. without gaps between the individual lengths T, after the cutting of the rolled stock billet W in the cross-cutting shears S, are transferred by way of a switch 5 pivotably or displaceably movable in a horizontal plane to a further relatively short separate trough section 8 which can be approximately from 3 to 6 m and over in length.

Figure 2:
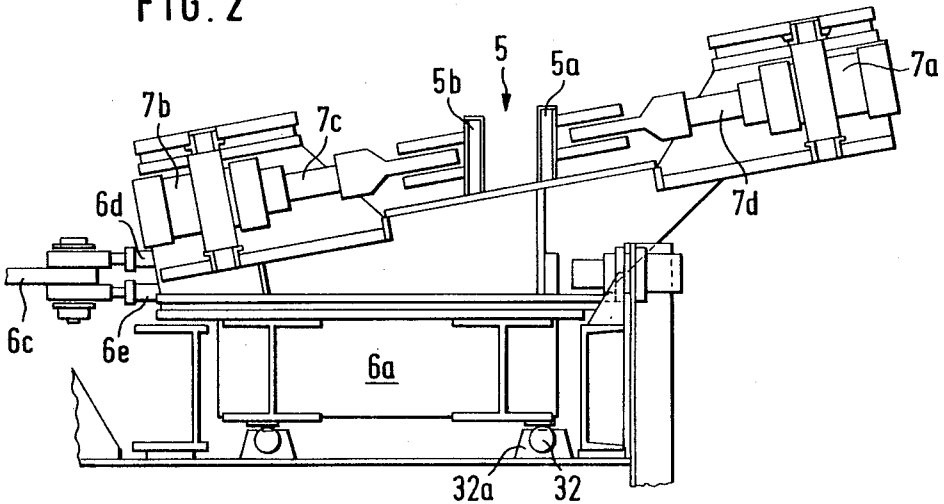
FIG. 2 is a cross-sectional view of the switch taken along the line II—II of FIG. 1.

As indicated in FIG. 2 the switch 5 is secured for example to a sliding table 6*a*, which is displaceably movable transversely to the conveying direction R about a vertical pivot axis C situated at the entry end. The sliding table 6a is supported on rollers 32 rotatably mounted in support bearings 32a.

Figure 3:
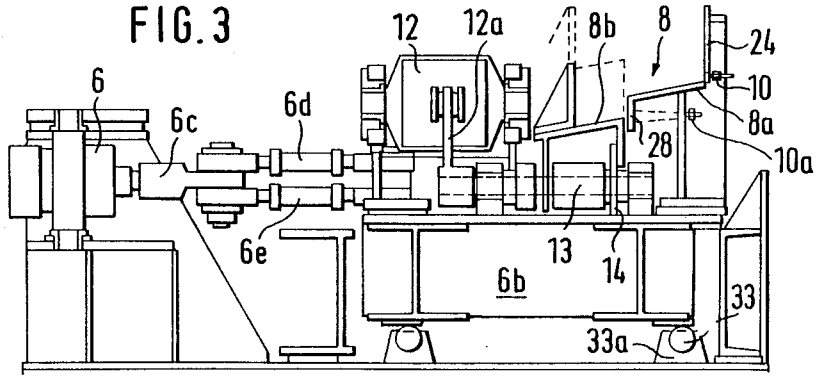
FIG. 3 is a cross-sectional view of the separate trough section taken along the line III—III of FIG. 1.

The lateral guide walls 5a, 5b of the switch 5 are also pivotable in a horizontal plane for example about vertical axes a, b situated at the entry end. For this purpose displacement drives in the form of hydraulic power means 7a, 7b for example are linked by way of piston rods 7c, 7d to the delivery ends of the guide walls 5a, 5b. The short separate trough section 8 following the switch 5 is, as illustrated in FIG. 3, subdivided into two paralled longitudinal sections 8a and 8b. The longitudinal section 8a is in the form of a fixed trough guide inclined laterally towards the adjacent longitudinal section 8b, and the longitudinal section 8b is in the form of a vertically displaceable trough guide which is inclined in the same way transversely to the conveying direction R, as illustrated in FIGS. 3 and 5. In the lowered position of the longitudinal section 8b in FIGS. 5A and 7A its base forms a depresssed portion at a lower level beside and below the conveying plane F of the fixed longitudinal section 8a; in the raised position according to FIG. 6A the lateral vertical defining wall of the longitudinal section 8b facing the longitudinal section 8a forms a guide for the longitudinal section 8a. The sliding table 6b of the trough section 8 is linked—together with the sliding table 6a of the switch 5—to the piston rod 6c of an hydraulic power means 6 by way of rods 6d, 6e and can be slid by the said hydraulic power means 6 transversely to the conveying direction R about vertical axes c and d at the entry end and delivery end respectively. For this purpose the trough section 8 is mounted on a sliding table 6b which is supported on rollers 33 pivotably mounted in step bearings 33a. The sliding table 6b can be displaceably moved in a horizontal plane transversely to the conveying direction R about a vertical axis d. The vertically displaceable trough guide 8b can, as shown in FIG. 3, be raised and lowered for example by an hydraulic power means 12, the piston rod being linked to a pivot lever 12a which is mounted rotationally rigidly on a shaft 13. The vertically displaceable trough guide of the longitudinal section 8b is linked by its supports to the free ends of levers 14 which are mounted rotatably rigidly on the shaft 13. Roller table rollers 19 for example pass axially through the fixed longitudinal section 8a transversely to the conveying direction R.

Figure 1:
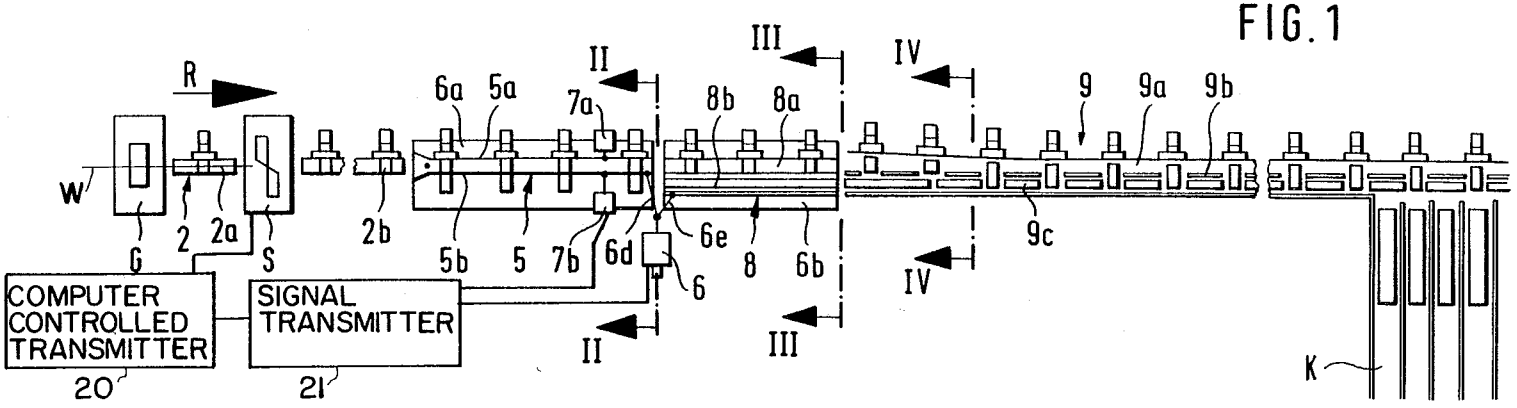
FIG. 1 is a schematic top plan view of the live-roller feed bed between the rolling train and the cooling bed in accordance with the invention.
Figure 4:
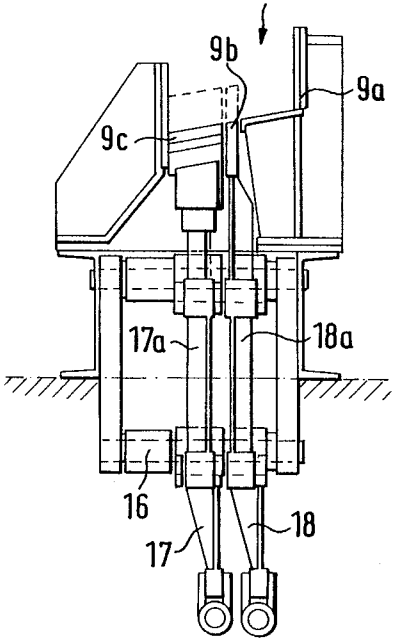
FIG. 4 is a cross-sectional view of the live-roller feed bed taken along the line IV—IV of FIG. 1.

A live-roller feed bed 9, which extends to the cooling bed K and which is subdivided into three parallel longitudinal sections 9a, 9b and 9c as shown in FIGS. 1 and 4, follows the trough section 8 in the conveying direction R. A longitudinal section 9a, tapering in the manner of a funnel at the entry end and having fixed base plates inclined transversely to the conveying direction R is arranged at the side opposite the cooling bed K. Next to it is a longitudinal section 9b with vertically displaceable separating means in the form of separating strips. Next to this is a further longitudinal section 9c which is in the form of base plates, the so-called braking slides, likewise inclined transversely to the conveying direction R. Roller table rollers 20 pass through the three parallel longitudinal sections 9a, 9b and 9c in known manner transversely to the conveying direction R. FIG. 4 shows the live-roller feed bed 9 in cross-section. The separating strips of the longitudinal section 9b and the braking slides of the longitudinal section 9c can be raised or lowered independently of one another in known manner, as the separating strips and the braking slides are linked to angle levers 17, 18 pivotable about shafts 16 by way of linking plates 17a, 18a and the levers are linked to pull rods (not shown).

The position of the individual trough sections relative to one another is shown diagrammatically in plan view and in cross-section in FIGS. 5, 5A, 6, 6A, 7 and 7A. FIG. 5 shows the entry of the leading end, FIG. 6 the passage of the middle part and FIG. 7 the passage of the trailing end of an individual length T.

The mode of operation of the plant is described below with reference to FIGS. 5, 5A to 7, 7A.

Figure 5A:
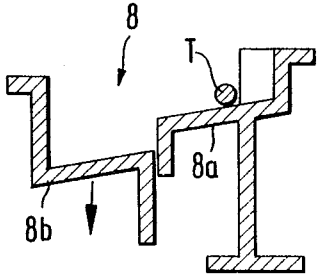
FIG. 5A is a cross-sectional view of the separate trough section taken along the line V—V in FIG. 5.
Figures 5, 6, 7, 8:
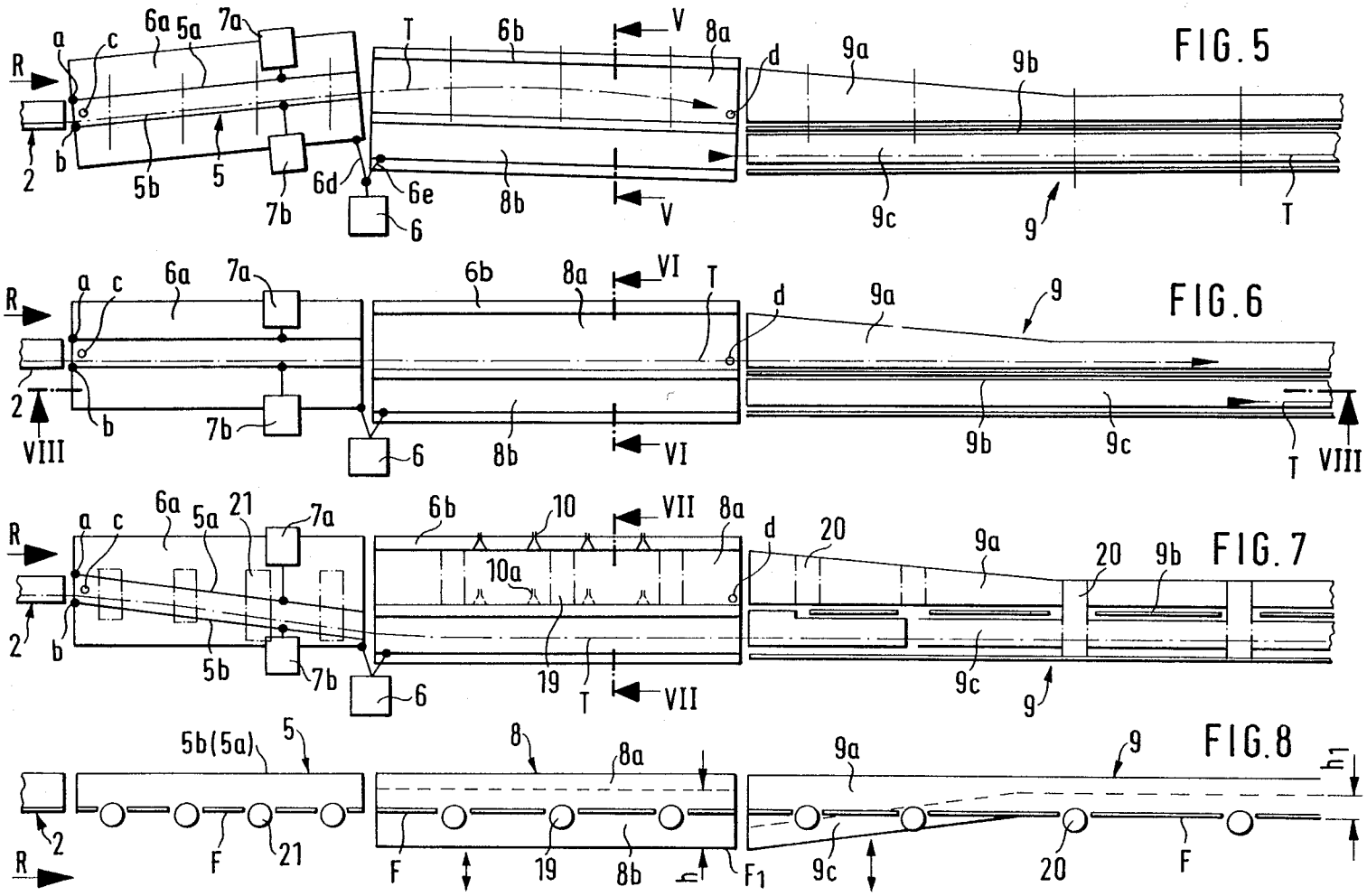
FIG. 5 is a schematic top plan view of the switch, trough section and live-roller feed bed with the leading end of a length of rolled stock entering.
FIG. 6 is a schematic top plan view of the switch, trough section and live-roller feed bed with the middle portion of the length of rolled stock entering.
FIG. 7 is a schematic top plan view of the switch, trough section and live-roller feed bed with the trailing end of the length of rolled stock entering.
FIG. 8 is a schematic longitudinal cross-sectional view through the live-roller feed bed taken along the line VIII—VIII of FIG. 6.

The length T cut in each case from the rolled stock billet W in the cross-cutting shears S travels with its leading end from the live-roller feed bed 2 through the switch 5 into the fixed section 8a of the short separate trough section 8, after the switch 5 and the trough section 8 have been previously swung out together in a horizontal plane about the vertical pivot axes c and d laterally to the conveying direction R by means of the hydraulic power means 6 in such a way that the leading end of the length T, as shown in FIG. 5, is given a slight inclination towards the outer lateral vertical trough wall of the fixed longitudinal section 8a, in order to be able to cross the gaps still existing at this time in the lateral vertical guide wall towards the adjacent longitudinal section 8b in an operationally reliable manner on a curved path of travel and, as illustrated in FIGS. 5 and 5A, to be further conveyed on the roller table rollers 20 by way of the funnel-shaped enlargement on the fixed longitudinal section 9a of the live-roller feed bed 9. The longitudinal section 9b with the vertically displaceable separating means has already been raised into its upper position in known manner by a lifting drive (not shown) by way of pull rods 18a to which the individual separating means in the form of the separating strip section 9b are linked by means of angle levers 18 and linking plates 18b pivotable about axes 16.

Figure 6A:
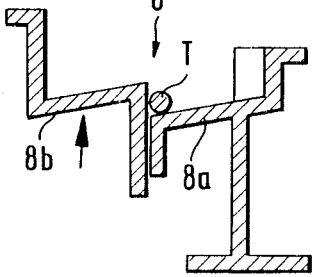
FIG. 6A is a cross-sectional view of the separate trough section taken along the line VI—VI in FIG. 6.

As soon as the leading end of the length T has entered the fixed longitudinal section 9a, the switch 5 and the shorter separate trough section 8 are swung back again into a deflection-free, rectilinearly aligned conveying line by means of the hydraulic power means 6 and at the same time, as shown diagrammatically in FIG. 6A, the vertically displaceable longitudinal portion 8b is raised into its upper position by the stroke h, so that the length T is guided in the longitudinal portion 8a along the lateral wall of the longitudinal portion 8b and further in the longitudinal portion 9a along the raised separating means 9b.

Figure 7A:
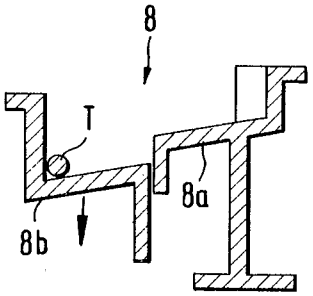
FIG. 7A is a cross-sectional view of the live-roller feed bed taken along the line VII—VII in FIG. 7.

When the length T has moved far enough into the longitudinal section 9a of the live-roller feed bed 9, the separating strips of the longitudinal section 9b and the vertically displaceable longitudinal section 8b and the lateral guide walls 5a and 5b of the switch 5, as shown in FIG. 7, are pivoted about their vertical axes a and b by the power means 7a and 7b in such a way that the discharge opening of the switch 5 is directed into the lowered longitudinal section 8b. The length T then moves out of the longitudinal sections 8a and 9a as a result of the lateral inclination of the conveying plane in a sliding movement transversely to the conveying direction R, into the longitudinal section 8b forming a depressed portion with its trough base at a lower level, as shown in FIG. 7A, and into the following longitudinal section 9c, the trailing end of the length T being drawn in as a result of introduction into the lowered deeper longitudinal section 8b, while the guide walls 5a and 5b of the switch 5 have already been swung back again into the rectilinear position; before the trailing end of the leading length T is discharged the switch 5 and the trough section 8 are moved again into the position shown in FIGS. 5 and 5A with the longitudinal sections 8*a* and 9*a* in alignment with each other in order to introduce the leading end of the length T which follows practically without a gap.

Figure 9:
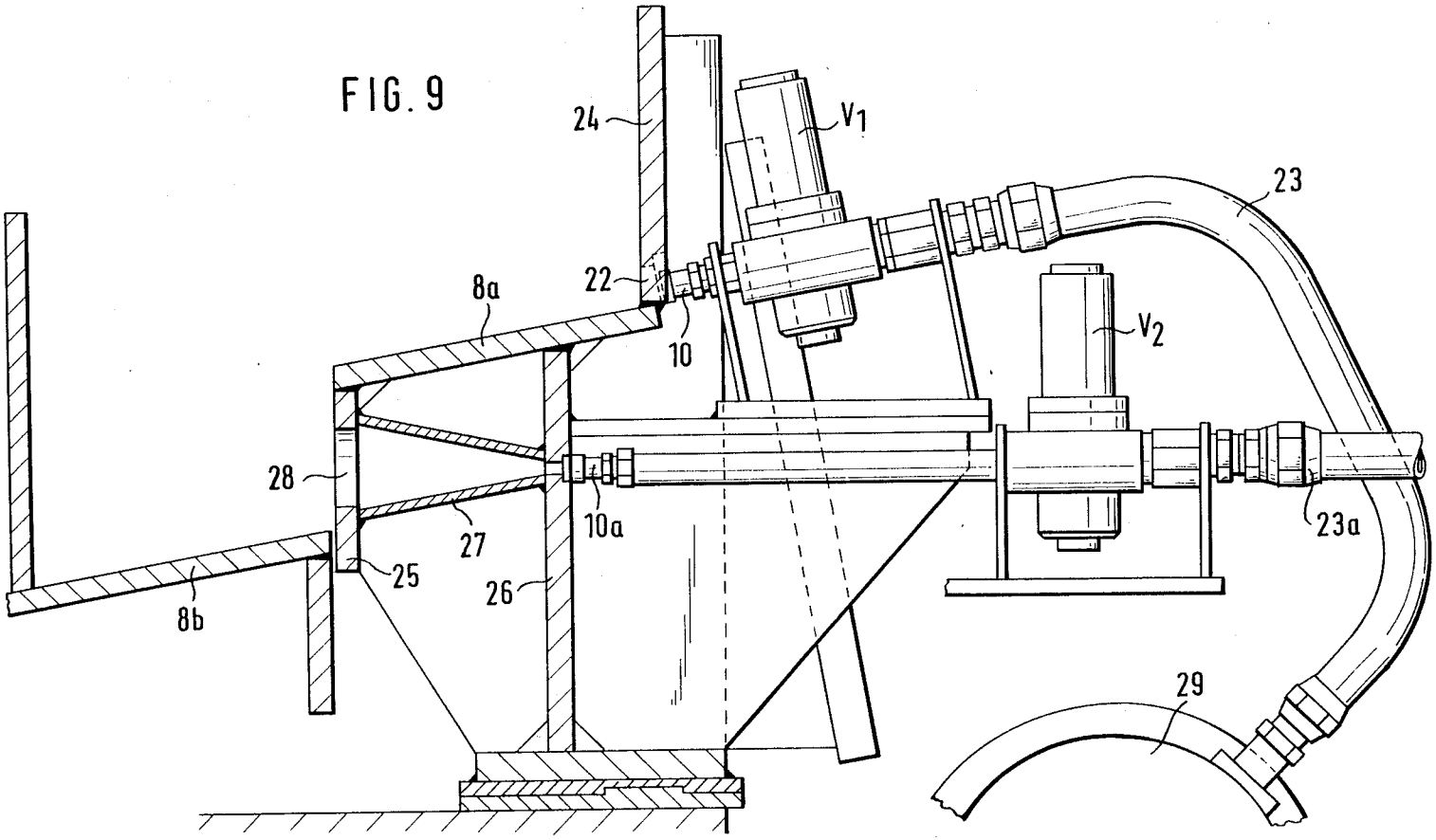
FIG. 9 is a cross-sectional view showing the arrangement of air nozzles in the trough section behind the switch.

In order to assist the overrun movement transverse to the conveying direction R from the region of the fixed longitudinal sections 8*a* and 9*a* into the region of the longitudinal sections 8*b* and 9*c*, in particular in the region of the longitudinal section 8*a*, compressed air nozzles 10, which are directed onto the base of the trough transversely to the conveying direction R and by means of which compressed air is blown onto the length T during the sliding movement, are disposed along the vertical trough wall of the longitudinal section 8*a*, as shown in FIGS. 3 and 9. Further compressed air nozzles 10*a*, the blowing direction of which is directed onto the base of the longitudinal section 8*b*, can also be disposed on the lateral vertical trough wall towards the longitudinal section 8*b* along the fixed longitudinal section 8*a*.

As is evident from the diagrammatic longitudinal section of FIG. 8, in the lowered bottom position the vertically displaceable longitudinal section 8*b* is disposed with its trough base in the conveying plane $F_1$ below the conveying plane F and thus forms a depressed portion into which the trailing end can be withdrawn without lashing. In order that the length T of rolled stock can pass smoothly from the lowered longitudinal section 8*b* up to the level of the conveying plane F in the longitudinal braking section 9*c*, an obliquely ascending guide which is vertically displaceable through the stroke $h_1$ with the other braking means is provided in the longitudinal section 9*c* at the inlet end. The longitudinal section 8*b* can be raised by the stroke h from its bottom position into its upper position, so that its lateral guide wall towards the longitudinal section 9*a* closes the gap towards the longitudinal section 9*a*.

The displacement means 6, 7*a* and 7*b*, the sliding tables 6*a* and 6*b*, the switch 5 and the short trough section 8 and the guide walls 5*a* and 5*b* of the switch 5 and the vertically displaceable longitudinal sections 8*b*, 9*b* and 9*c* can for example be actuated as a function of the cutting command of the cross-cutting shears S by way of a computer-controlled transmitter 20 and signal transmitter 21, or transmitters schematically shown in FIG. 1, controlled as a function of time or running speed. These transmitters can be operatively connected to the drive means 6, 7*a*, 7*b*, 12, for example, in a conventional manner.

In the region of the switch 5, wider roller table rollers 21 are disposed on the sliding table 6*a* along the rolled stock guide in such a way that when the guide walls 5*a* and 5*b* are pivoted, as shown for example in FIG. 7, they are still within the roller width of the rollers 21 and so the length T is fed forward by the rollers 21.

Roller table rollers 19 also preferably pass through the longitudinal section 8*a* with fixed base plates.

One exemplary embodiment of the arrangement of the compressed air nozzles 10 and 10*a* along the outer and inner vertical lateral walls 24 and 25 of the longitudinal section 8*a* with fixed base plates is illustrated in FIG. 9. The compressed air nozzles 10 are preferably disposed in the lower region of the vertical lateral wall 24 and directed transversely to the conveying direction onto the base of the trough of the longitudinal section 8*a* through an opening 22, while the compressed air nozzles 10*a* are secured for example on a supporting wall 26 and are directed, by way of a funnel-shaped air duct 27 and an opening 28 in the lower lateral wall 25 of the longitudinal section 8*a*, onto the base of the trough—at its bottom position—of the longitudinal section with vertically displaceable base plates 8*b*. The compressed air nozzles 10 and 10*a* can be controlled by way of valves $V_1$ and $V_2$ and are connected to a compressed air supply 29 by way of hoses 23 and 23*a*.

The embodiments of the invention illustrated in the drawings are given by way of example only; their structural components are interchangeable with equivalent means while retaining the essential function of the device.

Thus for example the extent of the displacement path of the sliding tables 6*a* and 6*b* for the common horizontal lateral deflection movement of the switch 5 and the trough portion 8 can be set as a function of the bending resistance of the profile cross-section in question.

In addition, it is possible, in particular in the case of bending-resistant profile cross-sections, such as flat and U-shaped profiles, for successive lengths T to be separated by laterally offsetting the alignment line of the guide wall 5*b* to the guide wall 5*a* with respect to the alignment line of the longitudinal section of the separating means 9*b*. In this way a vertical guide strip of relatively little height which may be altered in length and position can where required be mounted on the longitudinal section 8*b* on the longitudinal side towards the longitudinal section 8*a*.

We claim:

1. In a roller feed bed, for conveying cut lengths of a rolled product along a travel path and to a cooling bed disposed laterally adjacent to one side of the roller feed bed and travel path, including a conveying roller table for conveying the lengths to the cooling bed and having a fixed longitudinal guide channel, a braking section parallel and laterally adjacent to the guide channel and provided with vertically displaceable braking means for braking the cut lengths, and vertically displaceable separating means between the guide channel and braking section, the braking section having an operative position lower than the guide channel and the cooling bed being laterally adjacent the braking section for receiving the cut lengths therefrom, and switching means disposed upstream of the conveying roller table for directing the cut lengths into selected laterally adjacent paths, the improvement comprising:

a guide trough disposed between the switching means and the roller table having an entry end adjacent the switching means and an exit end adjacent the roller table;

means mounting said guide trough for horizontal pivotal movement transversely to the travel path of the cut lengths about a vertical axis at said exit end;

a first longitudinal section on said guide trough having a fixed base aligned with the guide channel of the roller table;

a second longitudinal section on said guide trough laterally adjacent said first longitudinal section aligned with the braking section and having a vertically movable base so that said second longitudinal section is movable between a lower and a raised operative position lower and higher respectively than said first longitudinal section;

said guide trough in cross-section being laterally inclined downwardly from said first section to said second section towards the side of the travel path of the cut lengths at which the cooling bed is disposed;

drive means operatively connected to said second longitudinal section for moving said second section vertically between said raised and lowered positions;

further drive means operatively connected to said guide trough and switching means for simultaneously moving the entry end of said guide trough and the adjacent end of said switching means laterally transversely to the travel path of the cut lengths to selectively direct by the switching means the cut lengths into said first longitudinal section in a direction diverging obliquely from said second section or in a substantially straight line;

and drive means operatively connected to said switching means for moving said switching means independently of said guide trough for selectively aligning the switching means with said first and second longitudinal sections of said guide trough.

2. A roller feed bed as claimed in claim 1 and further comprising:

a first slide table mounted upstream of and adjacent to said guide trough for pivotal movement transversely to the travel path of the cut lengths about a vertical pivot axis;

said switching means being mounted on said first slide table.

3. A roller feed bed as claimed in claim 1 wherein said means mounting said guide trough comprises:

a second slide table mounted for pivotal movement about said vertical axis at said exit end of said guide trough;

said guide trough being mounted on said second slide table.

4. A roller feed bed as claimed in claim 2 and further comprising:

a second slide table mounted for pivotal movement about said vertical axis at said exit end of said guide trough;

said guide trough being mounted on said second slide table; and wherein said further drive means comprises a second common drive means operatively connected to said slide tables at mutually adjacent positions thereon for effecting said simultaneous movement of said guide trough and switching means.

5. A roller feed bed as claimed in claim 4 wherein said switching means comprises:

spaced side walls movably mounted on said first slide table; and side wall drive means operatively connected to said side walls for moving said side walls independently of movement of said guide trough.

6. A roller feed bed as claimed in claim 5 wherein the roller feed bed includes cross-cutting shears upstream of the switching means for cutting rolled stock into the cut lengths and wherein the improvement further comprises:

a computer controlled transmitter operatively connected to said cross-cutting shears and said drive means to control the actuation of said slide tables and side walls of said switching means as a function of the cutting command of the shears.

7. A roller feed bed as claimed in claim 1 wherein:

said first longitudinal section of said guide trough has upright side walls; and further comprising compressed air nozzles operatively mounted in at least one of said side walls to direct compressed air toward the lower part of at least one of said first and second longitudinal sections.

8. A roller feed bed as claimed in claim 1 wherein:

the entry end of said fixed guide channel adjacent said guide trough is enlarged and has the shape of a funnel.

9. A roller feed bed as claimed in claim 1 wherein:

the conveying roller table slopes upwardly obliquely in the braking section at the entry end thereof adjacent said guide trough, for conveying said cut lengths from said lower position of said second section to the conveying plane of the braking section.

10. A roller feed bed as claimed in claim 1 wherein, said guide trough is relatively short with respect to the switching means and roller table.

11. In a live roller feed bed for conveying individual lengths of rolled stock running in succession to cooling beds downstream of the feed bed including, a roller table section having an inlet end, a fixed guide trough at the inlet end, a switch disposed downstream of the fixed guide trough, and a following conveying roller table subdivided into three parallel longitudinal sections comprising a fixed guide trough section, a section having a vertically displaceable braking means and a longitudinal section having a vertically displaceable separating means interposed between the fixed guide trough section and braking means section, the improvement comprising:

an entry end or exit end on said switch;

an entry end on said conveyor roller table;

means mounting said switch for pivotal movement in a horizontal plane transversely to the conveying line about a vertical axis at said entry end of the switch;

a separate trough section shorter in length than the conveying roller table interposed between the exit end of the switch and the entry end of the conveying roller table;

means mounting said shorter trough section for pivotal movement in a horizontal plane transversely to the conveying line about a vertical axis at the discharge end thereof adjacent said conveying roller table;

a first longitudinal section on said shorter trough section having fixed base plates;

a second longitudinal section laterally adjacent said first section and having independently vertically displaceable base plates;

means connected to said base plates to move said vertically displaceable base plates so that the stroke thereof extends from a lower position below the conveying plane of said first section to a raised position above the conveying plane of said first section;

said shorter trough section being inclined downwardly in cross-section to the side of the roller feed bed at which the cooling beds are disposed;

means connected to said switch to laterally divert the exit end of the switch and the entry end of the shorter trough section jointly in the same direction;

guide walls on the switch; and means mounting said guide walls for individual displaceable movement independently of each other.

* * * * *